US012584656B2

(12) United States Patent
Strader et al.

(10) Patent No.: US 12,584,656 B2
(45) Date of Patent: Mar. 24, 2026

(54) WATER HEATER ASSEMBLY FOR A RECREATION VEHICLE AND METHOD FOR OPERATION

(71) Applicant: Haier US Appliance Solutions, Inc., Wilmington, DE (US)

(72) Inventors: Jacob Strader, La Grange, KY (US); Subbu Thenappan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 537 days.

(21) Appl. No.: 17/972,222

(22) Filed: Oct. 24, 2022

(65) Prior Publication Data

US 2024/0133589 A1 Apr. 25, 2024
US 2024/0230158 A9 Jul. 11, 2024

(51) Int. Cl.
*F24H 9/20* (2022.01)
*F24H 1/00* (2022.01)

(52) U.S. Cl.
CPC ..... *F24H 9/2007* (2013.01); *F24H 1/009* (2013.01)

(58) Field of Classification Search
USPC ..... 237/12.3 R
See application file for complete search history.

(56) References Cited

U.S. PATENT DOCUMENTS

| | | | | |
|---|---|---|---|---|
| 5,960,157 | A * | 9/1999 | McGraw | G05D 23/1909 392/441 |
| 8,322,312 | B2 | 12/2012 | Strand | |
| 9,206,995 | B2 | 12/2015 | Nelson et al. | |
| 10,436,476 | B2 | 10/2019 | Boros et al. | |
| 2009/0179079 | A1* | 7/2009 | Ruijven | B60H 1/00364 392/441 |
| 2009/0191493 | A1 | 7/2009 | Guzorek | |
| 2011/0114034 | A1* | 5/2011 | Aycock | F24H 15/33 122/14.2 |
| 2012/0282557 | A1* | 11/2012 | Hokanson | F23L 13/02 236/1 G |
| 2024/0077203 | A1* | 3/2024 | Strader | F23M 9/08 |

* cited by examiner

*Primary Examiner* — Steven B Mcallister
*Assistant Examiner* — John E Bargero
(74) *Attorney, Agent, or Firm* — Dority & Manning, P.A.

(57) ABSTRACT

A water heater for a recreation vehicle and method for control are provided. The water heater includes a tank including a plenum configured to hold water within the tank. A flue forms a flowpath including an inlet opening and an outlet opening. A flow control device is positioned to selectively allow flow through the outlet opening from the flowpath. The flow control device forms a closed position and an open position. A motor is operably coupled to the flow control device and configured to articulate the flow control device to the closed position and the open position.

6 Claims, 5 Drawing Sheets

WATER HEATER ASSEMBLY FOR A RECREATION VEHICLE AND METHOD FOR OPERATION

FIELD OF THE INVENTION

The present subject matter relates generally to water heaters for recreation vehicles.

BACKGROUND OF THE INVENTION

Recreation vehicles may include water heaters for providing heated water for various cooking and cleaning uses at a recreation vehicle. Water heaters may include various heating methods, such as electric or gas heating. When a water heater includes gas and electric heating methods, significant heat and efficiency losses may occur. As such, a recreation vehicle and water heater that mitigates or eliminates significant heat and efficiency loses would be beneficial.

BRIEF DESCRIPTION OF THE INVENTION

Aspects and advantages of the invention will be set forth in part in the following description, or may be apparent from the description, or may be learned through practice of the invention.

An aspect of the present disclosure is directed to a water heater for a recreation vehicle. The water heater includes a tank including a plenum configured to hold water within the tank. A flue forms a flowpath including an inlet opening and an outlet opening. A flow control device is positioned to selectively allow flow through the outlet opening from the flowpath. The flow control device forms a closed position and an open position. A motor is operably coupled to the flow control device and configured to articulate the flow control device to the closed position and the open position.

Another aspect of the present disclosure is directed to a computer-implemented method for operating a water heater for a recreation vehicle. The method includes transmitting a heater control signal to a heater assembly of the water heater to generate thermal energy for heating water, the heater control signal including a first heater control signal corresponding to an electric heating mode, the heater control signal including a second heater control signal corresponding to a gas heating mode; and transmitting a motor control signal to a motor configured to selectively articulate a flow control device at a flue forming a flowpath through which exhaust gases egress, wherein the motor is configured to articulate the flow control device to the closed position and the open position based on whether the first heater control signal or the second heater control signal is transmitted.

Yet another aspect of the present disclosure is directed to a controller for a water heater. The controller is configured to execute instruction that cause the water heater to perform operations. The operations include transmitting a heater control signal to a heater assembly of the water heater to generate thermal energy for heating water, the heater control signal including a first heater control signal corresponding to an electric heating mode, the heater control signal including a second heater control signal corresponding to a gas heating mode; and transmitting a motor control signal to a motor configured to selectively articulate a flow control device at a flue forming a flowpath through which exhaust gases egress, wherein the motor is configured to articulate the flow control device to the closed position and the open position based on whether the first heater control signal or the second heater control signal is transmitted.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
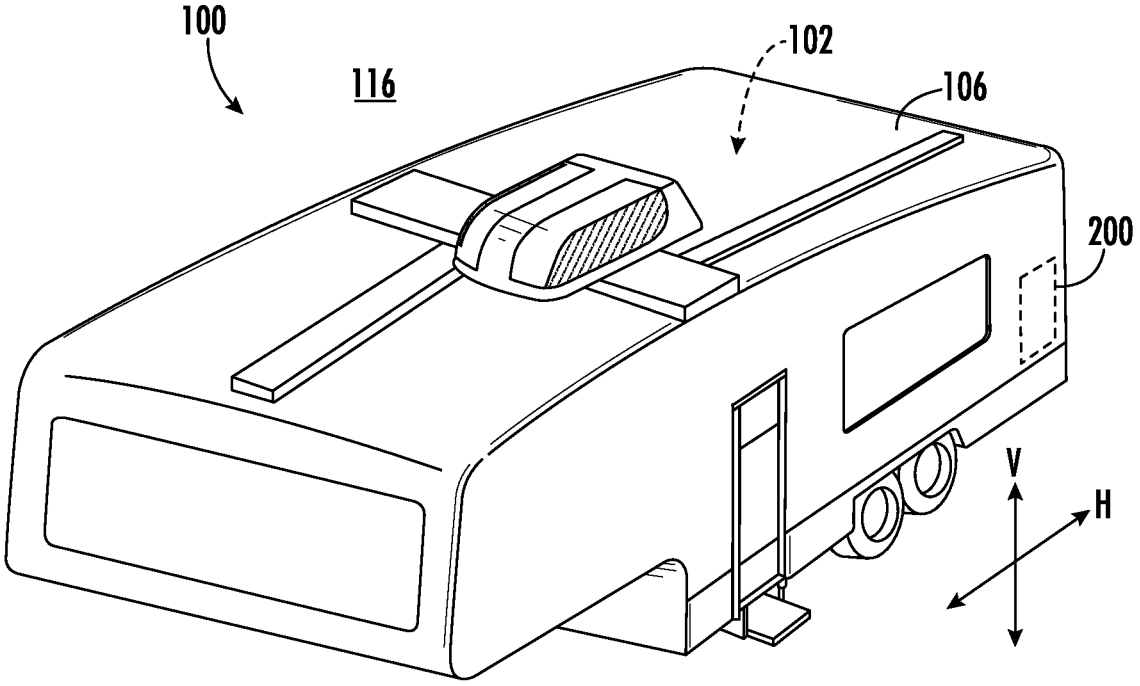
FIG. 1 provides a perspective view of a recreation vehicle according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components. In addition, as used herein, terms of approximation, such as "approximately," "substantially," or "about," refer to being within a ten percent margin of error.

FIG. 1 provides a perspective view of an exemplary recreation vehicle 100 in accordance with the present disclosure. People may employ recreation vehicle 100 for a variety of purposes, including transportation, cooking, eating, sleeping, entertaining, and the like. As such, recreation vehicle 100 defines a passenger compartment 102, which may further include a bed, stove, table, restroom, or multiple compartments for storing items that passengers wish to take with them on their travels. A schematic embodiment of a water heater assembly 200 is depicted and included with the recreation vehicle 100. As further described herein in regard to FIGS. 2-4, the water heater assembly 200 includes a system and method for selectively closing a flue, such as based on gas or electric heating operation of the water heater. In various embodiments, the water heater assembly 200 may be positioned such as to access various components of the water heater assembly 200 from an exterior 116 of the recreation vehicle 100, such as from an exterior surface 106 of the recreation vehicle 100.

Figure 2:
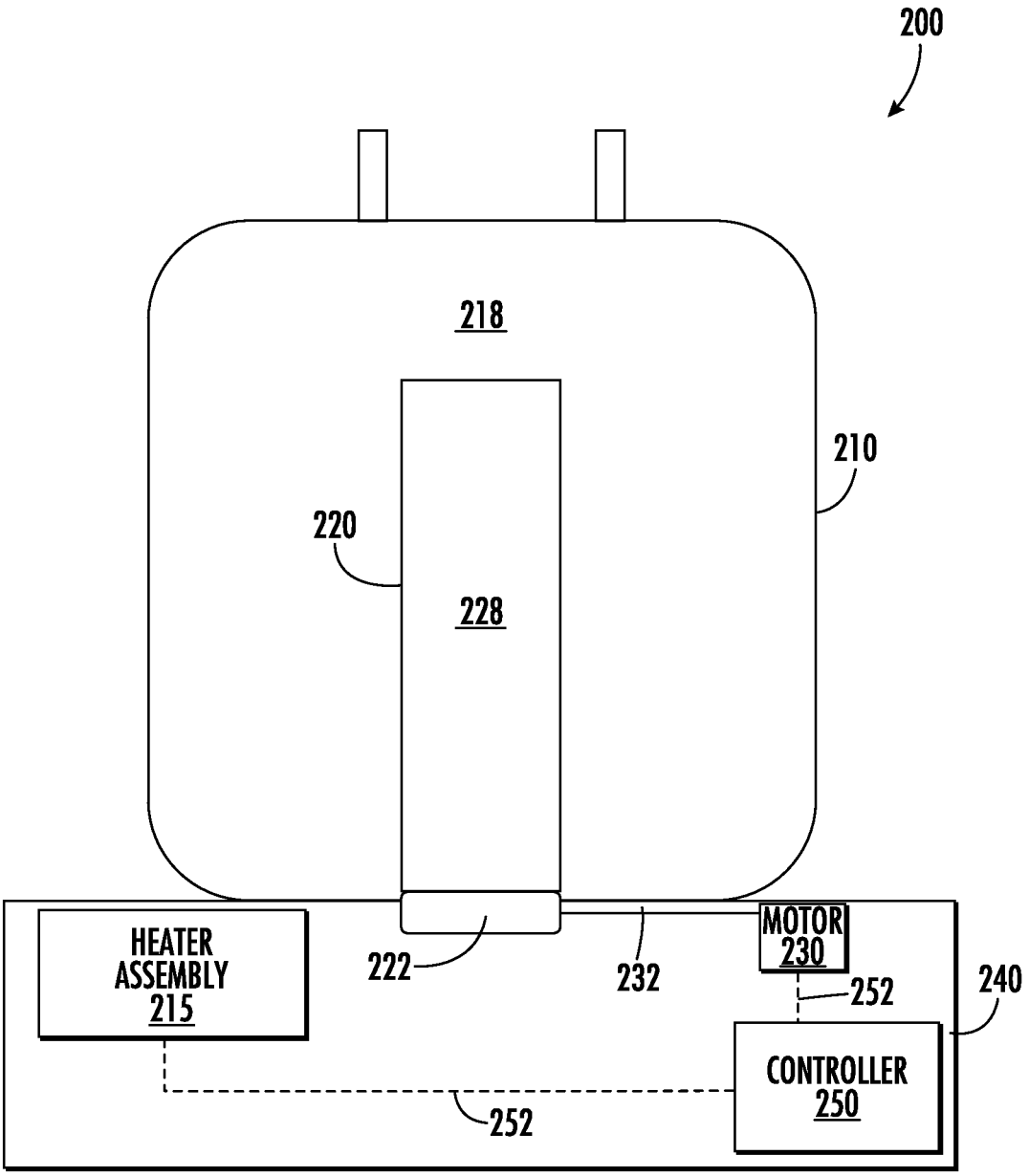
FIG. 2 provides a top-down view of a schematic embodiment of the water heater in accordance with aspects of the present disclosure.

Referring to FIG. 2, a top view of an exemplary schematic embodiment of the water heater 200 is provided. The water heater 200 includes a reservoir or tank 210 forming an interior volume or plenum 218 at which water is received and stored for heating. The water heater 200 may include any desired devices for heating the water. In particular embodiments, the water heater 200 includes a heater assembly 215 including a gas heating structure and an electric heating structure configured to operate in a gas heating mode, an electric heating mode, or a combination gas and electric heating mode.

Figure 3A:
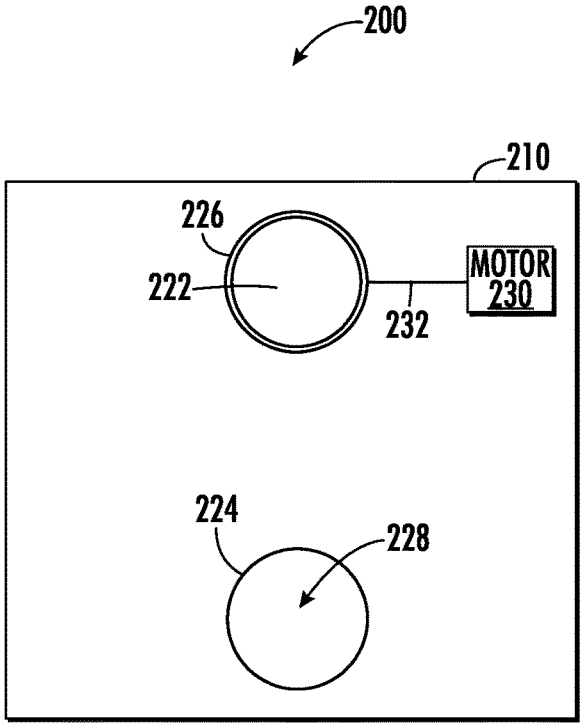
FIG. 3A provides a front view of a schematic embodiment of a water heater in a closed position in accordance with aspects of the present disclosure.
Figure 3B:
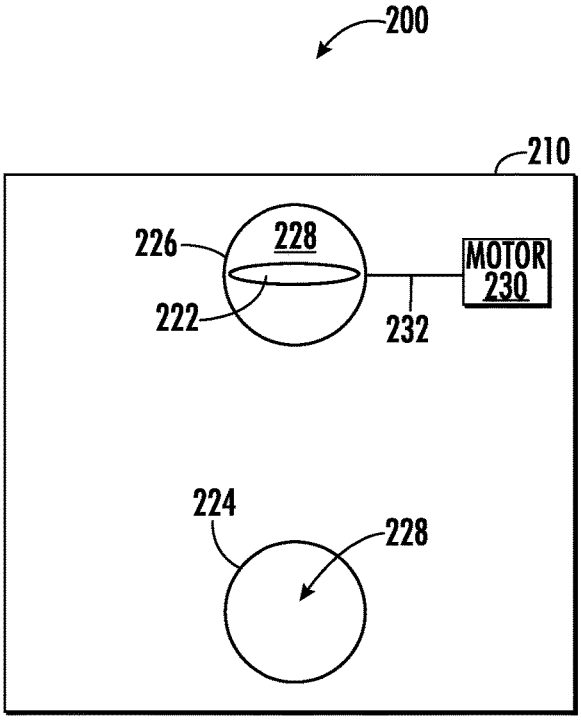
FIG. 3B provides a front view of a schematic embodiment of the water heater in an open position in accordance with aspects of the present disclosure.
Figure 4A:
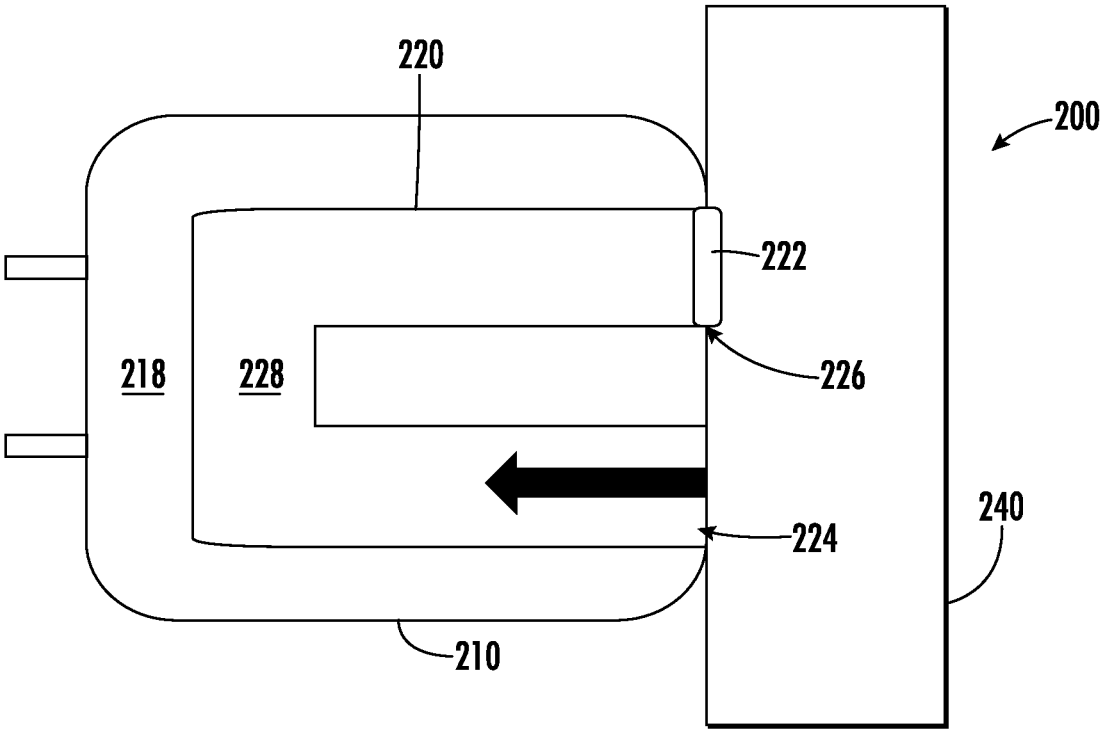
FIG. 4A provides a side view of a schematic embodiment of the water heater in a closed position in accordance with aspects of the present disclosure.
Figure 4B:
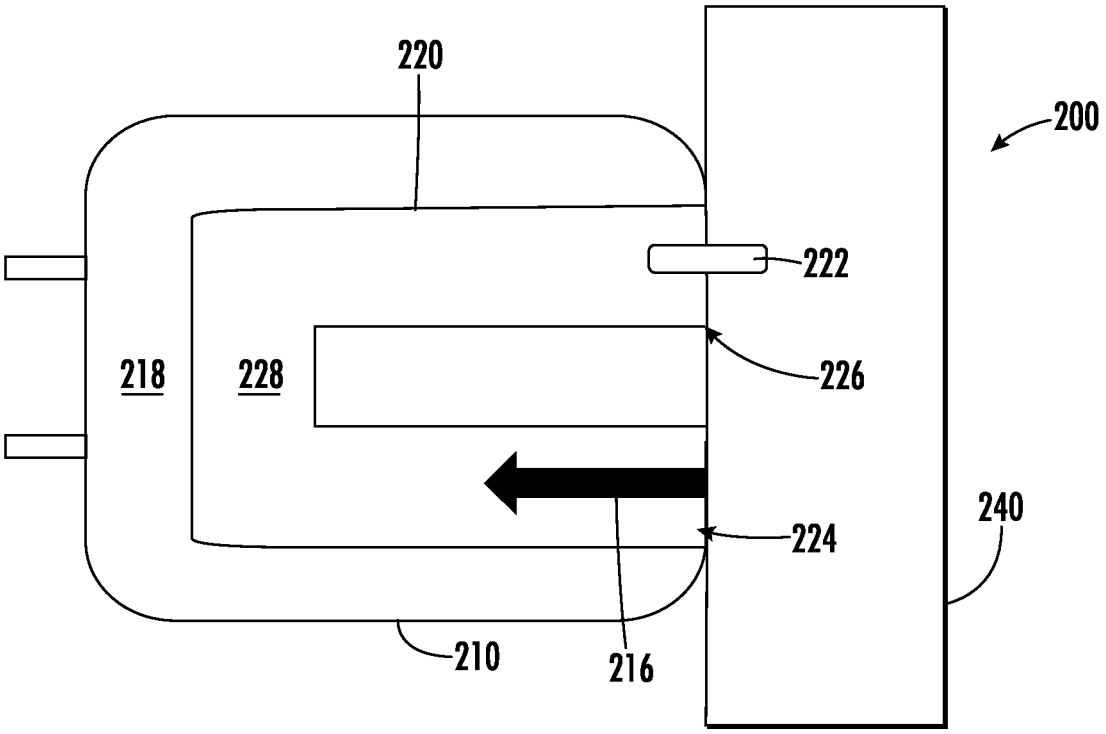
FIG. 4B provides a side view of a schematic embodiment of the water heater in an open position in accordance with aspects of the present disclosure.

FIGS. 3A-3B provide front views of an exemplary embodiment of the water heater 200. FIGS. 4A-4B provide side views of an exemplary embodiment of the water heater 200. Referring to FIG. 2, FIGS. 3A-3B, and FIGS. 4A-4B, the water heater 200 includes a walled duct or flue 220. The flue 220 forms a flowpath 228 through which hot gases, smoke, or waste gases produced by the gas heater may flow and exhaust, such as depicted schematically in FIG. 4B at arrow 216. Embodiments of the flue 220 may extend into the plenum 218. As such, heat from gases in the flowpath 228 may transfer to water in the plenum 218.

The flue 220 includes an inlet opening 224 at a first end of the flowpath 228 and an outlet opening 226 at the flowpath 228 distal to the inlet opening 224. A valve, damper, or other flow control device 222 is positioned to selectively allow flow (e.g., gases) to exhaust from the flowpath 228. In some embodiments, the flow control device 222 is positioned at the outlet opening 226. In such embodiments, gases may be permitted to flow or permeate substantially through the flowpath 228. When the flow control device 222 is in a closed position, such as depicted in FIG. 3A and FIG. 4A, gases (e.g., cold air or heat from the electric heater mode) may be inhibited from egressing the flowpath 228. When the flow control device 222 is in an open position, such as depicted in FIG. 4A and FIG. 4B, gases may be permitted to egress from the flowpath 228.

Referring to FIG. 2 and FIGS. 3A-3B, a motor 230 is operably coupled to the flow control device 222 to selectively articulate the flow control device 222 between the closed position (FIG. 3A and FIG. 4A) and the open position (FIG. 3B and FIG. 4B). In some embodiments, a shaft 232 operably couples the motor 230 to the flow control device 222. The motor 230 may include any appropriate rotary or linear actuating mechanism to articulate (e.g., rotate) the flow control device 222 between the closed position and the open position.

Referring to FIG. 2, in still some embodiments, one or more of the motor 230, the shaft 232, and the flow control device 222 are positioned at a front enclosure 240. The front enclosure 240 may form a panel, door, removable wall, or articulatable wall allowing selective access by a user to a front portion of the water heater 200. The water heater 200 may include a controller 250 communicatively coupled to the motor 230 and the heater assembly 215, such as via a wireless or wired communications bus 252.

Referring to FIG. 2, FIGS. 3A-3B, and FIGS. 4A-4B, in various embodiments, the controller 250 is configured to receive a command signal corresponding to a user command or temperature threshold signal. The controller 250 is configured to transmit a heater control signal to the heater assembly 215 to generate heat or thermal energy for heating water at the plenum 218. The heater control signal may include a first heater control signal corresponding to operating the heater assembly 215 in an electric heating mode and a second heater control signal corresponding to operating the heater assembly 215 in a gas heating mode. The controller 250 may be configured to transmit both the first heater control signal and the second heater control signal, such as to command operation of the heater assembly 215 in both a gas heater mode and an electric heater mode. Stated differently, the controller 250 may be configured to transmit a third heater control signal corresponding to operating the heater assembly 215 in both the gas heating mode and the electric heating mode.

The controller 250 is configured to transmit a motor control signal to the motor 230 to selectively articulate the flow control device 222 based on the heating mode operated at the heater assembly 215. For instance, the controller 250 may be configured to transmit the motor control signal to the motor 230 to selectively articulate the flow control device 222 between the closed position and the open position based on whether the first heater control signal or the second heater control signal is transmitted to the heater assembly 215.

When the controller 250 transmits the first heater control signal, or when operating in the electric heating mode, the controller 250 transmits a first motor control signal to command the motor 230 to articulate the flow control device 222 to the closed position. In some embodiments, the controller 250 is configured to transmit the first motor control signal to articulate the flow control device 222 to the closed position when the heater assembly 215 is not operating in the gas heating mode (e.g., second heater control signal) or not operating in the gas and electric heating mode (e.g., third heater control signal). In still some embodiments, the motor 230, the shaft 232, or the flow control device 222 may be biased to the closed position when at rest. For instance, one or more of the motor 230, the shaft 232, or the flow control device 222 may include springs or other biasing mechanisms that bias the flow control device 222 when not operating in the gas heating mode or gas and electric heating mode.

When the controller 250 transmits the second heater control signal or the third heater control signal, or when operating in the gas heating mode or the gas and electric heating mode, the controller 250 transmits a second motor control signal to command the motor 230 to articulate the flow control device 222 to the open position.

In some embodiments, the controller 250 may be configured to obtain or otherwise receive a position signal corresponding to an actual or measured position of the flow control device 222. In certain embodiments, the motor 230 is configured to transmit the position signal to the controller 250 (e.g., via communications bus 252). The position signal corresponds to whether the flow control device 222 is substantially in the closed position or substantially in the open position. The controller 250 may be configured to delay execution or operation of the heater assembly 215 in the gas heater mode until the position signal corresponding to the open position is received at the controller 250.

In still some embodiments, after operation of the heater assembly 215 in the gas heating mode (e.g., second heater control mode) or gas and electric heating mode (e.g., third heater control signal), the controller 250 may be configured to delay transmitting the first motor control signal to close the flow control device 222 until a predetermined period of time elapses after discontinuing operation of the heater assembly 215 in the gas heating mode or gas and electric heating mode. The delay may permit exhaust gases generated since operation of the gas heater to egress from the flowpath 228.

Embodiments of the controller 250 may include one or more processors and one or more memory devices. The one or more memory devices may be configured to store instructions that, when executed by the one or more processors, causes the water heater assembly 200 to perform operations such as described herein. The memory device(s) may be configured to store instructions, or related steps, data, schedules, etc. for operating the heater assembly 215 and the motor 230 in accordance with embodiments such as described herein.

The controller 250 may include a user interface panel configured to provide selections for user manipulation of the operation of water heater 200, such as e.g., selections between an electric heating mode, a gas heating mode, or combination gas and electric heating mode. In response to user manipulation of the user interface panel, the controller 250 operates various components of the water heater 200, such as the heater assembly 215 and the motor 230. Controller 250 may be positioned in a variety of locations throughout water heater 200. In the illustrated embodiment shown in FIG. 2, the controller 250 is located within or at a face of the front enclosure 240. In such an embodiment, input/output ("I/O") signals may be routed between controller 250 and various operational components of water heater 200. In one exemplary embodiment, the controller 250 may include a general purpose I/O ("GPIO") device or functional block. In another exemplary embodiment, the controller 250 may include input components, such as one or more of a variety of electrical, mechanical, or electro-mechanical input devices including push buttons, touch pads, touch screens, etc.

Figure 5:
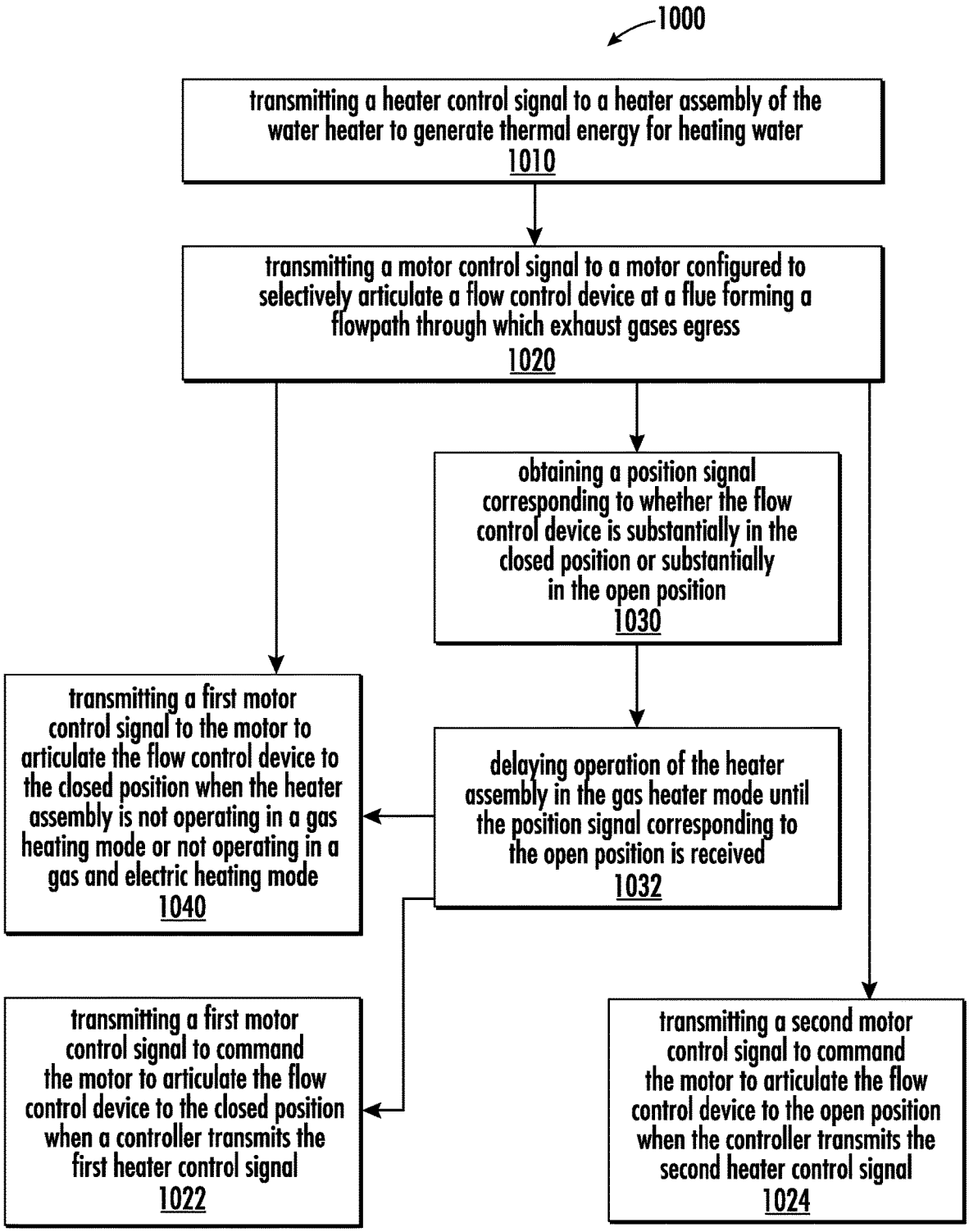
FIG. 5 provides a flowchart outlining exemplary steps of a method for operating a water heater in accordance with aspects of the present disclosure.

Referring to FIG. 5, a flowchart outlining exemplary steps of a method for operating a water heater assembly is provided (hereinafter, "method 1000"). Steps of the method 1000 may form one or more steps or operations for a controller (e.g., controller 250), such as to form a computer-implemented method. Embodiments of the method 1000 may be stored or executed as operations for a water heater, such as embodiments of the water heater 200 depicted and described herein. Some embodiments of the method 1000 may be stored or executed as operations for other appropriate types of water heaters, such as water heaters including gas heating mode, electric heating mode, or combination gas and electric heating mode.

Method 1000 includes at 1010 transmitting a heater control signal to a heater assembly (e.g., heater assembly 215) of the water heater (e.g., water heater 200) to generate thermal energy for heating water. The heater control signal includes a first heater control signal corresponding to an electric heating mode and a second heater control signal corresponding to a gas heating mode.

Method 1000 includes at 1020 transmitting a motor control signal to a motor (e.g., motor 230) configured to selectively articulate a flow control device (e.g., flow control device 222) at a flue (e.g., flue 220) forming a flowpath (e.g., flowpath 228) through which exhaust gases egress. The motor is configured to articulate the flow control device to the closed position and the open position based on whether the first heater control signal or the second heater control signal is transmitted.

In some embodiments, method 1000 includes at 1022 transmitting a first motor control signal to command the motor to articulate the flow control device to the closed position when a controller transmits the first heater control signal, and at 1024 transmitting a second motor control signal to command the motor to articulate the flow control device to the open position when the controller transmits the second heater control signal.

In still some embodiments, method 1000 includes at 1030 obtaining a position signal corresponding to whether the flow control device is substantially in the closed position or substantially in the open position. In some embodiments, method 1000 includes at 1032 delaying operation of the heater assembly in the gas heater mode until the position signal corresponding to the open position is received.

In yet still some embodiments, method 1000 includes at 1040 transmitting a first motor control signal to the motor to articulate the flow control device to the closed position when the heater assembly is not operating in a gas heating mode or not operating in a gas and electric heating mode.

Embodiments of the water heater 200 and recreation vehicle 100 provided herein may reduce heat loss to the environment during the electric heating mode, such as to permit increased efficiency of the water heater 200 and decreased thermal losses. Embodiments provided herein may include reduced stand-by heat loss after a gas heating mode cycle or electric heating mode cycle is completed.

Further embodiments of the present subject matter are provided in one or more of the following clauses:

1. A water heater for a recreation vehicle, the water heater including a tank including a plenum configured to hold water within the tank; a flue forming a flowpath, the flowpath including an inlet opening and an outlet opening; a flow control device positioned to selectively allow flow through the outlet opening from the flowpath, the flow control device forming a closed position and an open position; and a motor operably coupled to the flow control device, the motor configured to articulate the flow control device to the closed position and the open position.

2. The water heater of any one or more clauses herein, including a shaft operably coupling the motor to the flow control device to articulate the flow control device to the closed position and the open position.

3. The water heater of any one or more clauses herein, including a heater assembly including a gas heating mode and an electric heating mode, the heater assembly configured to generate exhaust gases through the flowpath at the flue when in the gas heating mode.

4. The water heater of any one or more clauses herein, wherein the motor is configured to articulate the flow control device to the closed position when the heater assembly is in the electric heating mode, and wherein the motor is configured to articulate the flow control device to the open position when the heater assembly is in the gas heating mode.

5. The water heater of any one or more clauses herein, including a controller communicatively coupled to the motor and the heater assembly.

6. The water heater of any one or more clauses herein, wherein the controller is configured to execute instruction that cause the water heater to perform operations, the operations including transmitting a heater control signal to the heater assembly to generate thermal energy for heating water at the plenum, the heater control signal including a first heater control signal corresponding to an electric heating mode, the heater control signal including a second heater control signal corresponding to a gas heating mode; transmitting a motor control signal to the motor to selectively articulate the flow control device to the closed position and the open position based on whether the first heater control signal or the second heater control signal is transmitted.

7. The water heater of any one or more clauses herein, wherein transmitting the motor control signal to the motor includes transmitting a first motor control signal to command the motor to articulate the flow control device to the closed position when the controller transmits the first heater control signal; and transmitting a second motor control signal to command the motor to articulate the flow control device to the open position when the controller transmits the second heater control signal.

8. The water heater of any one or more clauses herein, the operations including obtaining a position signal corresponding to whether the flow control device is substantially in the closed position or substantially in the open position.

9. The water heater of any one or more clauses herein, the operations including delaying operation of the heater assembly in the gas heater mode until the position signal corresponding to the open position is received at the controller.

10. The water heater of any one or more clauses herein, wherein the controller is configured to execute instruction that cause the water heater to perform operations, the operations including transmitting a first motor control signal to the motor to articulate the flow control device to the closed position when the heater assembly is not operating in a gas heating mode or not operating in a gas and electric heating mode.

11. A computer-implemented method for operating a water heater for a recreation vehicle, the method including transmitting a heater control signal to a heater assembly of the water heater to generate thermal energy for heating water, the heater control signal including a first heater control signal corresponding to an electric heating mode, the heater control signal including a second heater control signal corresponding to a gas heating mode; transmitting a motor control signal to a motor configured to selectively articulate a flow control device at a flue forming a flowpath through which exhaust gases egress, wherein the motor is configured to articulate the flow control device to the closed position and the open position based on whether the first heater control signal or the second heater control signal is transmitted.

12. The method of any one or more clauses herein, including transmitting a first motor control signal to command the motor to articulate the flow control device to the closed position when a controller transmits the first heater control signal; and transmitting a second motor control signal to command the motor to articulate the flow control device to the open position when the controller transmits the second heater control signal.

13. The method of any one or more clauses herein, the method including obtaining a position signal corresponding to whether the flow control device is substantially in the closed position or substantially in the open position.

14. The method of any one or more clauses herein, the method including delaying operation of the heater assembly in the gas heater mode until the position signal corresponding to the open position is received at the controller.

15. The method of any one or more clauses herein, the method including transmitting a first motor control signal to the motor to articulate the flow control device to the closed position when the heater assembly is not operating in a gas heating mode or not operating in a gas and electric heating mode.

16. A controller for a water heater, the controller configured to execute instruction that cause the water heater to perform operations, the operations including transmitting a heater control signal to a heater assembly of the water heater to generate thermal energy for heating water, the heater control signal including a first heater control signal corresponding to an electric heating mode, the heater control signal including a second heater control signal corresponding to a gas heating mode; transmitting a motor control signal to a motor configured to selectively articulate a flow control device at a flue forming a flowpath through which exhaust gases egress, wherein the motor is configured to articulate the flow control device to the closed position and the open position based on whether the first heater control signal or the second heater control signal is transmitted.

17. The controller of any one or more clauses herein, the operations including transmitting a first motor control signal to command the motor to articulate the flow control device to the closed position when a controller transmits the first heater control signal; and transmitting a second motor control signal to command the motor to articulate the flow control device to the open position when the controller transmits the second heater control signal.

18. The controller of any one or more clauses herein, the operations including obtaining a position signal corresponding to whether the flow control device is substantially in the closed position or substantially in the open position.

19. The controller of any one or more clauses herein, the operations including delaying operation of the heater assembly in the gas heater mode until the position signal corresponding to the open position is received at the controller.

20. The controller of any one or more clauses herein, the operations including transmitting a first motor control signal to the motor to articulate the flow control device to the closed position when the heater assembly is not operating in a gas heating mode or not operating in a gas and electric heating mode.

21. A controller for a water heater, the controller configured to execute the method of any one or more clauses herein.

22. A water heater for a recreation vehicle, including the controller of any one or more clauses herein.

23. A water heater for a recreation vehicle, configured to execute the method of any one or more clauses herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A computer-implemented method for operating a water heater for a recreation vehicle, the method comprising:

delaying operation of a heater assembly in a gas heater mode until a position signal corresponding to an open position is obtained, wherein the position signal corresponds to whether a flow control device at a flue forming a flowpath through which exhaust gases egress is substantially in the closed position or substantially in the open position;

transmitting a heater control signal to the heater assembly of the water heater to generate thermal energy for heating water, the heater control signal comprising a first heater control signal corresponding to an electric heating mode, the heater control signal comprising a second heater control signal corresponding to a gas heating mode;

transmitting a motor control signal to a motor configured to selectively articulate the flow control device, wherein the motor is configured to articulate the flow control device to the closed position and the open position based on whether the first heater control signal or the second heater control signal is transmitted, wherein transmitting the motor control signal to the motor comprises:

after elapse of a predetermined period of time after discontinuing operation of the heater assembly in the gas heating mode or the gas and electric heating mode, transmitting a first motor control signal to command the motor to articulate the flow control device to the closed position after the controller transmits the first heater control signal; and transmitting a second motor control signal to command the motor to articulate the flow control device to the open position after the controller transmits the second heater control signal and after the position signal corresponding to the open position is obtained.

2. The method of claim 1, wherein transmitting the first motor control signal comprises transmitting the first motor control signal to the motor to articulate the flow control device to the closed position when the heater assembly is not operating in a gas heating mode or not operating in a gas and electric heating mode.

3. A controller for a water heater, the controller configured to execute instruction that cause the water heater to perform operations, the operations comprising:

transmitting a heater control signal to a heater assembly of the water heater to generate thermal energy for heating water, the heater control signal comprising a first heater control signal corresponding to an electric heating mode, the heater control signal comprising a second heater control signal corresponding to a gas heating mode;

transmitting a motor control signal to a motor configured to selectively articulate a flow control device at a flue forming a flowpath through which exhaust gases egress, wherein the motor is configured to articulate the flow control device to the closed position and the open position based on whether the first heater control signal or the second heater control signal is transmitted, wherein transmitting the motor control signal to the motor comprises:

after elapse of a predetermined period of time after discontinuing operation of the heater assembly in the gas heating mode or the gas and electric heating mode, transmitting a first motor control signal to command the motor to articulate the flow control device to the closed position after the controller transmits the first heater control signal; and transmitting a second motor control signal to command the motor to articulate the flow control device to the open position after the controller transmits the second heater control signal.

4. The controller of claim 3, the operations comprising:

obtaining a position signal corresponding to whether the flow control device is substantially in the closed position or substantially in the open position.

5. The controller of claim 4, the operations comprising:

delaying operation of the heater assembly in the gas heater mode until the position signal corresponding to the open position is received at the controller.

6. The controller of claim 3, wherein transmitting the first motor control signal comprises:

transmitting the first motor control signal to the motor to articulate the flow control device to the closed position when the heater assembly is not operating in a gas heating mode or not operating in a gas and electric heating mode.

* * * * *